US010363452B2

(12) United States Patent
Alaniz, III

(10) Patent No.: US 10,363,452 B2
(45) **Date of Patent: *Jul. 30, 2019**

(54) ELASTIC EXERCISE DEVICE

(71) Applicant: Pedro M. Alaniz, III, Corpus Christi, TX (US)

(72) Inventor: Pedro M. Alaniz, III, Corpus Christi, TX (US)

( * ) Notice: Subject to any disclaimer, the term of this patent is extended or adjusted under 35 U.S.C. 154(b) by 207 days.

This patent is subject to a terminal disclaimer.

(21) Appl. No.: 15/434,006

(22) Filed: Feb. 15, 2017

(65) Prior Publication Data

US 2017/0232290 A1 Aug. 17, 2017

Related U.S. Application Data

(60) Provisional application No. 62/495,766, filed on Sep. 23, 2016, provisional application No. 62/389,044, filed on Feb. 16, 2016.

(51) Int. Cl.

| | |
|---|---|
| ***A41D 13/00*** | (2006.01) |
| ***A63B 21/00*** | (2006.01) |
| ***A63B 23/12*** | (2006.01) |
| ***A63B 21/055*** | (2006.01) |

(52) U.S. Cl.

CPC ..... *A63B 23/1245* (2013.01); *A41D 13/0015* (2013.01); *A63B 21/0552* (2013.01); *A63B 21/4007* (2015.10); *A63B 21/4017* (2015.10); *A63B 21/4025* (2015.10)

(58) Field of Classification Search

CPC ..... A63B 21/0004; A63B 21/00043; A63B 21/00178; A63B 21/00181; A63B 21/00185; A63B 21/002; A63B 21/0023; A63B 21/02; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/065; A63B 21/068; A63B 21/078; A63B 21/0783; A63B 21/4001; A63B 21/4007; A63B 21/4017; A63B 21/4023; A63B 21/4025; A63B 21/4027; A63B 21/4039; A63B 21/4043; A63B 23/035; A63B 23/03516; A63B 23/12; A63B 23/1209; A63B 23/1227; A63B 23/1236; A63B 23/1245; A63B 23/1254; A63B 23/1281; A63B 69/0057; A63B 69/0059; A63B 71/0054; A63B 2071/0063; A63B 2071/0072; A41D 13/0015

See application file for complete search history.

(56) References Cited

U.S. PATENT DOCUMENTS

| | | | | |
|---|---|---|---|---|
| 1,656,145 A | | 1/1928 | Davis | |
| 2,456,190 A | | 12/1948 | Heilbronner | |
| 3,056,401 A | * | 10/1962 | Greenspan | A61B 5/021 128/900 |
| 3,529,820 A | * | 9/1970 | Templeton | A63B 21/0004 482/122 |

(Continued)

*Primary Examiner* — Gary D Urbiel Goldner
(74) *Attorney, Agent, or Firm* — G. Turner Moller

(57) ABSTRACT

A chest and arm exercise device provides a chest spanning elastic member including a rubber sheet connected to a pair of elastic arm cuffs. A weight lifter's shirt includes a fabric body covering including an elastic chest spanning member and a pair of elastic sleeves or cuffs.

10 Claims, 5 Drawing Sheets

(56) References Cited

U.S. PATENT DOCUMENTS 4,273,328 A 6/1981 Ozbey
4,473,908 A 10/1984 Knecht
4,540,173 A * 9/1985 Hopkins, Jr. ..... A63B 21/0552 482/124
4,570,929 A 2/1986 Shoemaker
4,800,593 A 1/1989 Ruffner
4,852,874 A * 8/1989 Sleichter, III ..... A63B 21/0004 482/122
4,993,705 A * 2/1991 Tolle ..... A63B 21/00185 482/124
5,308,305 A * 5/1994 Romney ..... A63B 21/4025 2/69
5,383,235 A 1/1995 Peters
5,573,487 A 11/1996 Wallner
5,659,898 A * 8/1997 Bell, Jr. ..... A41D 13/0015 2/115
5,915,531 A 6/1999 Hilpert
5,957,878 A * 9/1999 Gilliam ..... A41D 13/0015 128/856
6,061,832 A 5/2000 Morrison
6,231,488 B1 * 5/2001 Dicker ..... A41D 13/0015 2/69
6,244,998 B1 * 6/2001 Hinds ..... A63B 21/0004 482/124
8,578,517 B2 * 11/2013 Alaniz ..... A41D 13/0015 2/115
8,771,155 B1 * 7/2014 Bell ..... A63B 69/0059 482/124
D748,209 S 1/2016 Alaniz
9,265,983 B1 2/2016 Bell
9,333,385 B2 * 5/2016 Hinds ..... A63B 21/02
9,707,433 B1 * 7/2017 McGibbons ..... A63B 21/1469
9,895,569 B2 * 2/2018 Yao ..... A63B 69/0028
2002/0160891 A1 * 10/2002 Gallagher ..... A63B 21/04 482/123
2007/0000015 A1 1/2007 Alaniz
2008/0214330 A1 9/2008 Goebel
2010/0218300 A1 * 9/2010 Alaniz ..... A41D 13/0015 2/115
2013/0298301 A1 * 11/2013 Petrakis ..... A63B 21/065 2/69
2014/0171275 A1 * 6/2014 Tatum ..... A63B 21/0004 482/124
2014/0317826 A1 * 10/2014 Decker ..... A41B 1/08 2/69
2015/0189927 A1 * 7/2015 Bunting ..... A41D 13/015 2/456
2016/0183606 A1 * 6/2016 Shriver ..... A63B 21/00065 2/69
2017/0106228 A1 * 4/2017 Belveal ..... A63B 21/4007
2017/0231798 A1 * 8/2017 Shin ..... A61F 5/02 2/44
2018/0035727 A1 * 2/2018 Cumiskey ..... A41D 13/0015
2018/0263303 A1 * 9/2018 Alaniz, III ..... A41D 13/0015

* cited by examiner

Fig.8
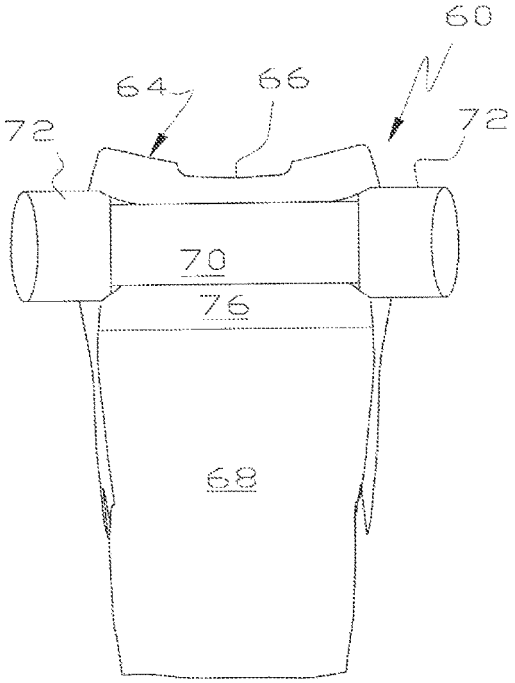
Fig.9
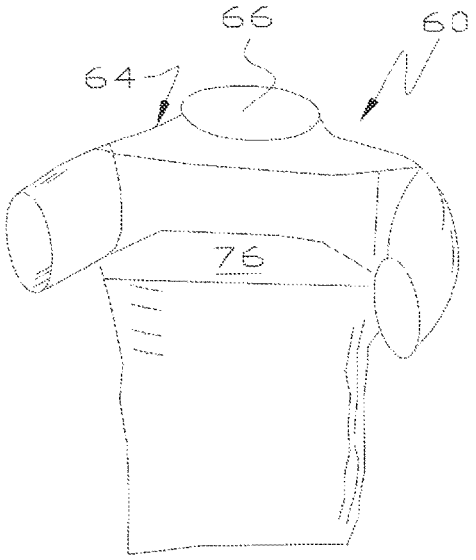
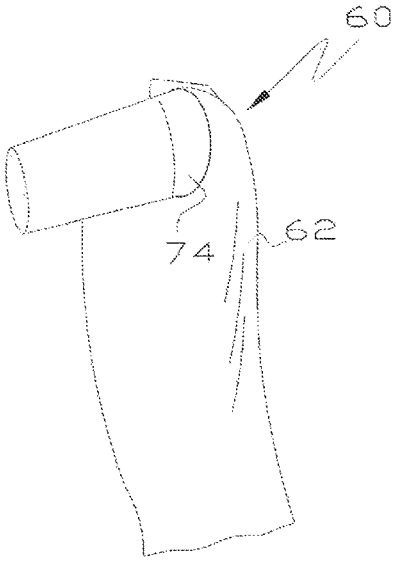
Fig.10
Fig.11
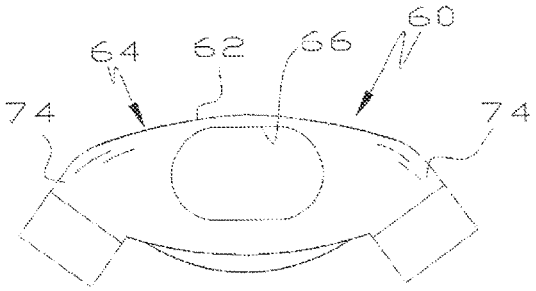

ELASTIC EXERCISE DEVICE

This application is partially based on Provisional U.S. Application Ser. No. 62/389,044 filed Feb. 16, 2016 and is partially based on Provisional U.S. Application Ser. No. 62/495,766 filed Sep. 23, 2016, priority of which are claimed.

This invention relates to an elastic member spanning the chest of a user to exercise the chest and arms of a user or which may be incorporated into a shirt for increasing the lift capacity of the user.

BACKGROUND OF THE INVENTION

There are a number of chest and arm exercising devices that incorporate cuffs receiving the arms of a user and an elastic band connecting the cuffs and extending across the chest. These devices are used when doing push ups, lifting weights in a bench press exercise, overhead presses, incline and decline presses and triceps dips. Typical devices are shown in U.S. Pat. Nos. D748,209, 4,273,328, 4,570,929, 5,573,487, 8,777,155, and 9,265,983 and U.S. Printed Patent Application 2008/0214330, the disclosures of which are incorporated herein by reference. It is this type device to which the disclosed elastic member most nearly relates. Other U.S. Patents of some interest are U.S. Pat. Nos. 2,808,267; 3,324,851; 4,799,675; 4,890,841 and 6,616,581.

Weight lifting is a sport, like all sports, where small differences in performance are the difference between winning and losing, especially in top flight competition. The reason, of course, is that competitors are normally very evenly matched. In order to provide a competitive edge, tight fitting weight lifter's shirts have been designed to store energy when a weight is lowered in order to assist the lifter in raising the weight, as shown in U.S. Pat. No. 4,473,908, the disclosure of which is incorporated herein by reference. This approach involves angling the sleeves of a lifter's shirt in a horizontal plane so that the shirt material, across the chest, is stretched on lowering the weight in order to contribute to the lifter's force in raising the weight.

Weight lifter's garments that are used in internationally sanctioned events are subject to considerable limitations because the controlling international associations prefer to limit or minimize the effect of the garment on the performance of the lifter. In other words, garments can be made that do not conform to the limitations normally imposed by bodies such as the International Powerlifting Federation (a governing body recognized by the General Association of International Sports Federations and the International Olympic Committee) but substantially improve lifters performances. By the same token, the International Powerlifting Federation wants to ensure that the garment is not prone to cause injury to the lifter.

The International Powerlifting Federation has rules which govern the type fabric and yarn which may be used in sanctioned lifting events. In unlimited lifting events, there are essentially no rules so garments may be made of any fabric and of any construction.

The regulatory body of some lifting groups now allow garments which clearly act to store energy and thereby improve the ability of lifters to raise weights.

Of some interest are U.S. Pat. Nos. 1,656,145; 2,456,190; 4,800,593; 5,383,235; 5,915,531 and 6,061,832. Disclosures of some interest relative to the disclosed weight lifting shirt are found in U.S. Pat. Nos. 4,473,908; 5,978,966; 6,047,406; 6,176,816; 6,231,488 and 6,892,396, U.S. Design Pat. No. 748,209 and U.S. Printed Patent Application 20070000015.

SUMMARY OF THE INVENTION

A chest and arm exercising device is disclosed having an improved chest band and improved arm cuffs. The chest band and arm cuffs includes an elastic band which may be made of a impermeable rubber or rubber-like sheet encased or partially encased in fabric. The rubber or rubber-like sheet provides desirable elastic characteristics in the exercise device while the fabric provides reduced frictional contact between the elastic sheet and the user's body. In addition, an improved technique is provided to secure the elastic chest band to the arm cuffs. Also in addition, a gripping device is secured adjacent a center of one or several edges of the chest band to allow a user or spotter to adjust the position of the exercise device on the user's chest.

For unlimited events, or so called extreme events, or events where the governing regulatory body allows garments to store energy, there are few if any limitations on the design or construction of the garment. In other words, garments can be made that do not meet international sanctioning association limitations but substantially improve lifter's performances. The lifter's garment disclosed herein substantially improves performances but will not pass current International Powerlifting Federation standards.

In one embodiment of a weight lifter's shirt, an elastic band extends across the shirt and connects to sleeves extending away from the band. The sleeves may also be of an elastic material so that, in a bench press lift, lowering of a weighted bar causes the elastic band to stretch thereby storing energy in the band and assisting the lifter to raise the weighted bar. The elastic band may be an elastic fabric or, in some embodiments, a rubber-like sheet.

BRIEF DESCRIPTION OF THE DRAWINGS

FIG. 8 is a front view of a shirt showing elastic sleeves and a band extending across a lifter's chest;

FIG. 9 is a pictorial front view of the shirt of FIG. 8, as the shirt would look if someone were wearing it;

FIG. 10 is a side view of the shirt of FIGS. 8-9;

FIG. 11 is a top view of the shirt of FIGS. 8-10;

DETAILED DESCRIPTION OF THE INVENTION

Figure 1:
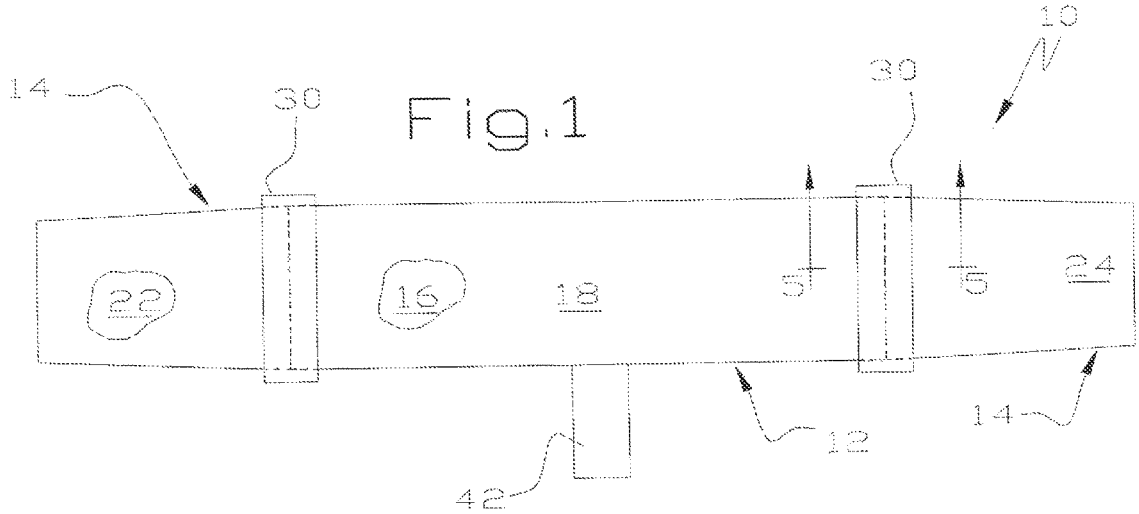
FIG. 1 is a front view of one embodiment of an exercise device, part of a fabric sleeve being cut away to show an elastic rubber sheet.
Figure 2:
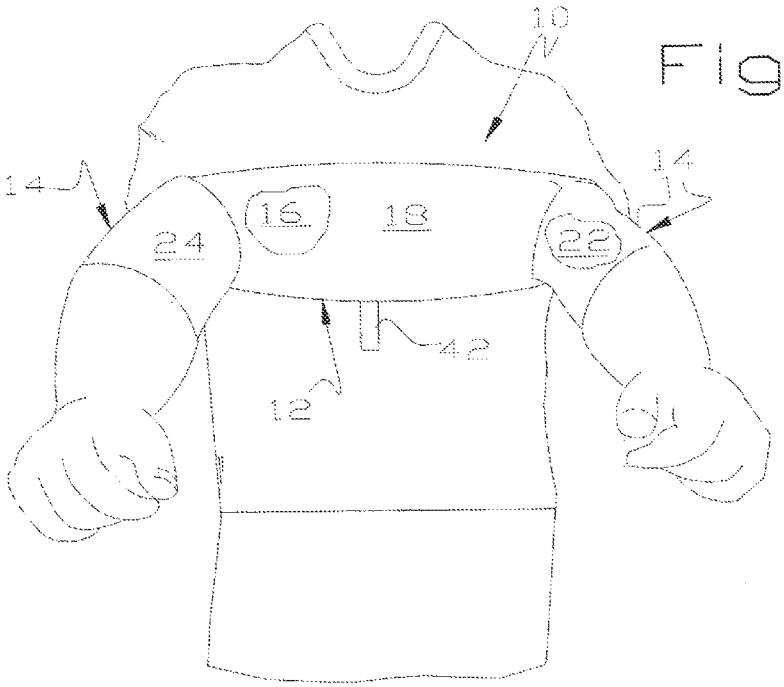
FIG. 2 is a front view of the exercise device of FIG. 1, worn over a tee shirt by a user.

Referring to FIGS. 1-6, an exercise device 10 comprises an elastic member or chest band 12 connected to left and right arm cuffs 14. The elastic band 12 may be a composite structure including a rubber or rubber-like sheet 16 encased in a sleeve 18 in the embodiment of FIG. 1. The rubber sheet 16 may preferably be elastic in both the long dimension between the cuffs 14 and the short dimension perpendicular to the long dimension.

The material of the rubber sheet 16 may be a natural or synthetic rubber of any suitable type. As used herein, rubber is a generic term meaning rubber, latex, organic polymer and the like which exhibit the characteristics of rubber. One suitable type is currently commercially available from The Hygenic Corp. of Akron, Ohio. Such latex or rubber sheets are typically impermeable having a slick exterior which is particularly suited to receive graphics which may be printed, silk screened or otherwise applied onto the exterior. As used herein, impermeable means that the material is not permeable even though the object may have inconsequential openings formed therein. The elasticity or resistance of the rubber sheet may vary considerably depending on the physical strength of the intended user. Exercise devices for women and children may be considerably more elastic or have considerably less resistance than for adult men and there may be considerable variation in the resistance for adult men depending on the degree of physical strength of the intended user. As used herein, the word sheet describes an object that has width, length and thickness where the width or length is at least ten times thickness and may preferably be twenty times thickness and ideally may be even larger, for example thirty times thickness.

The resistance of the elastic member 12 depends in part on the width of the sheet 16, the length of the sheet 16, the thickness of the sheet 16 and the strength of the material used. Appropriate selection of thickness, material characteristics, width and length cooperate to produce an exercise device having a desired resistance to stretching of the chest band 12. One suitable combination of thickness, length and width is a 15 centimeter or 5.9 inch width, a thickness of 4.5 millimeters or 0.177 inches and a length in proportion to the size of the user with the commercially available material. One combination of thickness, width and material produces a rubber sheet 16 having an elongation of about 25% at eighty pounds of tension and an elongation of about 50% at one hundred forty pounds of tension, both in a longitudinal direction between the arm cuffs 14 and in a direction perpendicular to the longitudinal direction.

In another embodiment, a suitable rubber sheet of 15 centimeter width, 4.5 millimeter thickness and 24 centimeter length exhibited a stretch of approximately 3" or 7.62 centimeters which is about 32% of the starting length.

It is apparent there may be a considerable variation in the resistance of the elastic member 12. A typical range of resistances, providing for adult men of different capacity, women of different capacity and children of different capacity would be about 25% elongation at 50-150 pounds tension and 50% elongation at 100-175 pounds tension.

It will be apparent that considerable variation may occur in thickness, width and material to provide the desired resistance to movement of the arm cuffs 14. In general, the thickness of the rubber sheet 16 may be between about one tenth to about three-eights inch thick to provide a substantial resistance to spreading of the arm cuffs 14 away from each other. The width of the rubber sheet may vary from about two inches to about ten inches, most of the width variation being in response to the variation in size of the user. The length of the rubber sheet 16 depends on the size of the individual for whom the exercise device 10 is made and may vary from about 4" (10 centimeters) to about 13" (33 centimeters).

The rubber sheet 16 may have surface characteristics that make it undesirable for contact with the chest or arms of a user in the sense that the sheet 16 may frictionally grab the user even though the user may be wearing a shirt. The friction generated by movement against clothing is unpredictable due to the wide variety of commercial shirts worn by lifters, athletes and general fitness lifters. Elasticity and friction properties of shirts can vary widely due to the varying contents of natural and synthetic fibers as well as pattern designs or ink in available commercial brands. When using heavy or maximum weights, smooth efficient form or technique is critical. Any inconsistency or jerky movements can lead to loss of form or technique that can lead to failure of the lift or potential injury. The disclosed construction assures that the device works efficiently regardless of what the user is wearing, either in the way of a shirt or bare-chested.

The sleeve 18 may be of any suitable material having the characteristic of not frictionally grabbing the rubber sheet 16 and typically may be a fabric made of natural fibers, synthetic fibers or a mixture of natural and synthetic fibers and which is sufficiently elastic to accommodate stretching of the rubber sheet 16. The sheet 16 may be encased in the sleeve 18 and secured thereto by conventional lines of stitching 20 or the like. In the alternative, a fabric sheet 26 may cover only the body side of a rubber sheet 28 as shown in FIG. 6.

Figure 3:
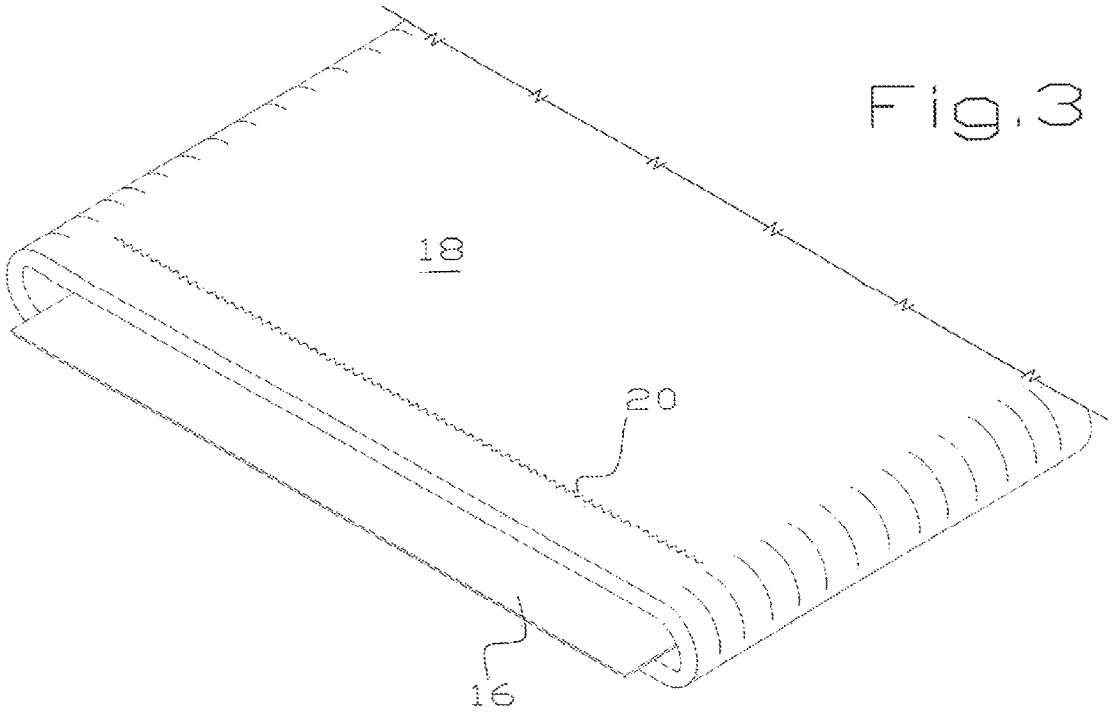
FIG. 3 is a view of one end of a chest band showing the connection between an internal rubber sheet and a fabric sleeve.
Figure 4:
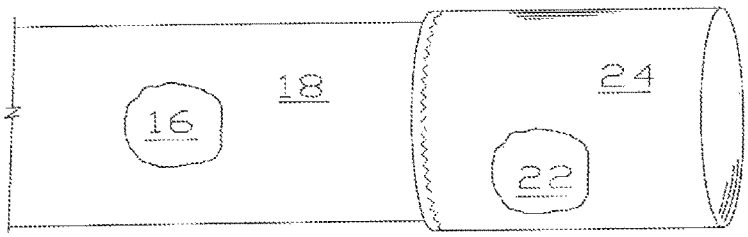
FIG. 4 is a view showing a connection between a chest band and an arm cuff.
Figure 5:
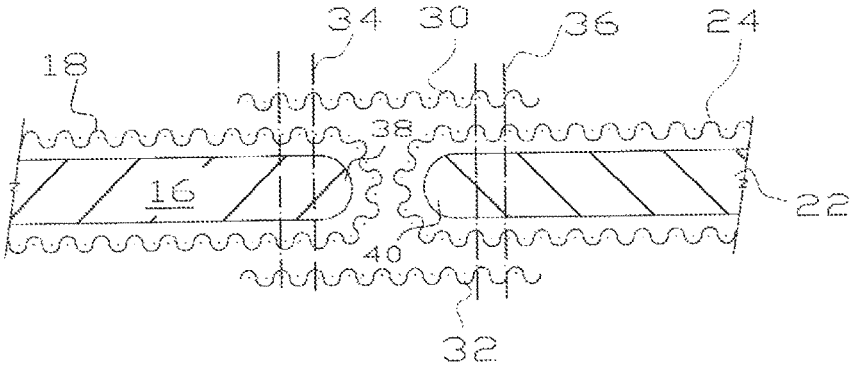
FIG. 5 is a cross-sectional view of FIG. 1 taken substantially along line 5-5 thereof as viewed in the direction indicated by the arrows, illustrating an elastic band enclosed in a fabric sleeve.

The arm cuffs 14 may be an elastic fabric material, as in the prior art, or may be a composite structure similar to the band 12 and thereby include a rubber or rubber like sheet 22 curled into a more-or-less circular shape and encased in a sleeve 24. The sheet 22 may preferably be sewn to the sleeve 24 by one or more lines of stitching in the same manner as shown in FIG. 3. The sheet 22 may be the same material as the sheet 16. The central or chest band 12 may be connected to the arm cuffs 14 in any suitable manner. In some embodiments where the sheets 16, 22 are thin enough to be overlapped and sewn together, the sheet ends may be overlapped and sewn to each other as suggested in FIG. 4. In situations where the sheets 16, 22 are thicker, ends of the rubber sheets 16, 22 preferably abut, rather than overlap, and are connected together in a suitable manner, as shown in FIGS. 1 and 5, as by gussets 30, 32 sewn along lines 34, 36 to abutting ends 38, 40 of the sheets 16, 22. The gussets 30, 32 may comprise a fabric of considerably more strength than the fabric of the sleeves 18, 24. This positions the chest band 12 on a periphery or circumference of the arm cuff 14 which is a desirable location.

A handle or loop 42 may be sewn to one or both edges of the rubber sheet 16 and thereby to the chest band 12 to allow a spotter to adjust the location of the elastic member 12 on the user's chest. FIG. 1 shows the loop 42 may be on a lower edge of the exercise device 10, i.e. on an edge of the chest band 12 away from the user's head.

Figure 6:
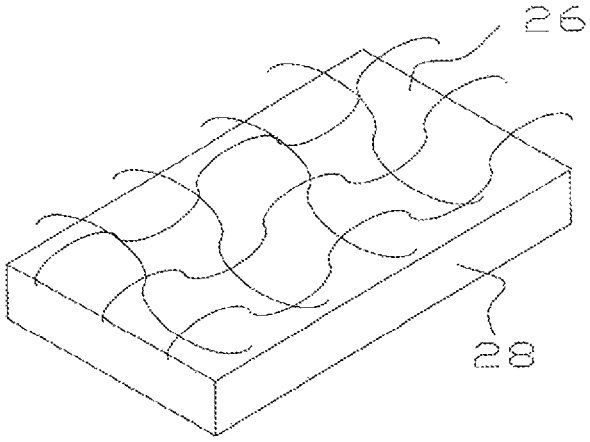
FIG. 6 is an isometric view showing an embodiment with a fabric on only one side of a rubber sheet.

Referring to FIG. 6, a chest band or arm cuff may include a sheet 28 of rubber, latex or elastic rubber like material having a fabric 26 on less than the complete periphery of the sheet 26. The fabric side of the chest band or arm cuff abuts the user's skin and provides little or no frictional contact between the sheet 28 and the user's skin or a shirt worn by the user.

Figure 7:
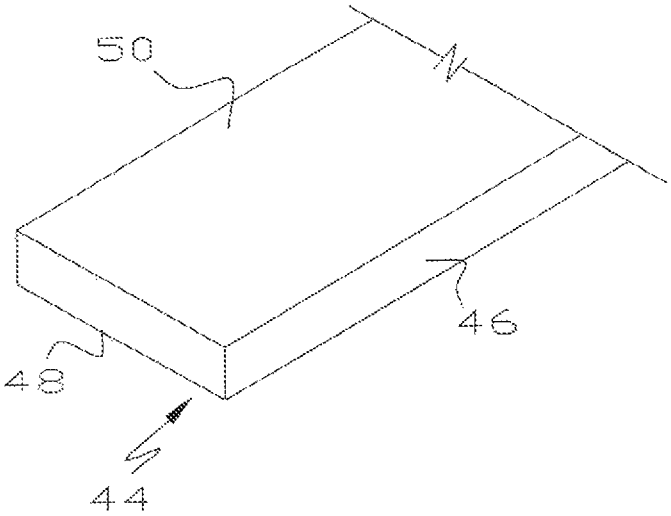
FIG. 7 is an isometric view showing the central elastic band with little or no fabric on either side.

Referring to FIG. 7, a chest band or elastic member 44 may comprise a rubber sheet 46 which is exposed to earth's atmosphere on both an inside 48 juxtaposed to the user's chest and an outside 50 facing away from the user. It is evident that both sides 48, 50 can be decorated with suitable graphics.

Use of a rubber sheet in the exercise device 10 has many advantages. The resistance of the sheet 16 is easy to change or design because it is a function of material, width, thickness and length, all of which can be selected to achieve a desired end. Because the sheet 16 has some considerable width, any tendency of the elastic band 12 to abrade the user or cause discomfort to the user is much reduced. Because the sheet 16 can be partially or wholly exposed, it provides a suitable surface for attractive and desirable graphics.

Use of the exercise device 10 should now be apparent, typically during push ups, bench press repetitions or simply moving the elbows rearwardly. The user's arms are inserted into the arm cuffs 14 and may cover the elbow and part of the upper arm. Any of these exercises act to elongate the elastic member 12 and provide resistance to movement of the user's arms. Use of the exercise device 10 is basically the same as commercially available versions.

Referring to FIGS. 9-12, a lifter's garment or shirt 60 is made of different materials, a relatively weak fabric providing most of the shirt 60 and a relatively strong elastic band extending across the chest of the user which acts to increase the user's lifting capacity. Although the garment 60 may be made of any suitable material, the preferred weak fabric is made of a heavy-weight polymeric yarn that is fairly stable with a slight to minimal stretch. Its properties include high modulus (power) characteristics, the ability to absorb more stress than fabrics made of natural fibers, the ability to better retain or return to its original shape than fabrics made from natural fibers, and the ability to expand or stretch before rupturing in a manner similar to taffy stretching before it breaks, unlike fabrics made from natural fibers which generally fail sooner and simply rupture.

The weak fabric may be wholly elastic or partly elastic and partly inelastic. The elastic fabrics stretch at least in a circumferential direction around the user's body and meaning they are not inelastic, by which is meant the material stretches less than 1-3% when pulled to the maximum ability by an adult male non-lifter, i.e. about 100 pounds, parallel to the weave and distorts when pulled on the bias but stretches less than 1-3%. The weak elastic fabric may be elastic in perpendicular directions but may preferably be elastic only in the circumferential direction around the user's body.

The back of the shirt 60 may be continuous, i.e. in the manner of a pull over shirt, may have openings therein or may be openable and include suitable straps, buttons, zippers or other means of securing back sections together. Lifter's shirts incorporating fabrics similar to the weak fabric material and inelastic fabrics are known in the prior art and are available from Titan Support Systems, Inc. of Corpus Christi, Tex. The shirt 60 is sized to be fairly tight on the wearer, typically about as tight as currently used lifting shirts.

The parts of the shirt 60 made of a fabric that may not store energy include a back 62, a neck/shoulder assembly 64 provides a neck hole 66 and a torso encircling section 68 which may include part of the back 62. The upper front assembly 64 may terminate near the top or ends of the user's shoulders. The neck/shoulder assembly 64 is accordingly spaced from the torso encircling section 68 by a gap which is closed or spanned by a band 70 extending across the front of the shirt 60 and across the lifter's chest. The back 62, assembly 64 and torso encircling section 68 may be of a weak elastic material or may be partly inelastic. The shirt 60 may also include elastic sleeves or cuffs 72 which may be at a forward angle in a manner similar to modern weight lifting shirts and as shown in U.S. Pat. No. 4,473,908. The sleeves 72 may extend at any desirable angle.

The material of the strong elastic part of the shirt 60, i.e. the band 70 and sleeves 72, may be a fabric, a non-woven sheet, a rubber sheet or any other suitable elastic material. A suitable elastic fabric material is a heavy woven fabric comprising natural rubber yards and synthetic polymer yarns, such as polyester or nylon, for added strength. A recommended count of rubber yarn assemblies is in the range of 25-60 wrapped yarn assemblies per three inch width. Each wrapped yarn assembly may comprise four smaller rubber yarns for a total rubber yarn count in the range of 100-240 rubber yarns per three inch width. A preferred count of rubber yarn assemblies may be 40 wrapped yarn assemblies each comprising four smaller rubber yarns for a preferred count of 160 rubber yarns. The weight of a preferred elastic material may be 121 grams per yard or 4.27 ounces/yard. This compares to a common brand of three inch wide elastic material found in most fabric stores of 41 grams per yard or 1.44 ounces/yard. A preferred elastic material is available from North East Knitting, Inc. of Pawtucket, R.I. to which reference is made for a more complete description of the elastic fabric material A suitable rubber sheet material is described above.

The sleeves 72 are accordingly sewn or otherwise affixed to the band 70 in the same manner that the cuffs 14 are connected to the elastic member 12 so that movement of a weight lifter's arms to the rear, or downwardly, in a bench press movement, moves the sleeves 72 and thereby stretches the band 70.

The neck/shoulder assembly 64 may include stub sleeves 74 visible in FIGS. 10 and 11 that are attached, as by sewing or the like, to the elastic sleeves 72 which may be cylindrical or only slightly tapered having edges perpendicular to an axis of the cylinder. The neck/shoulder assembly 64 is affixed to the upper edge of the elastic band 70 in any suitable manner, by sewing or the like. The lower front 68 is affixed to the lower edge of the elastic band 70, also by sewing or any other suitable technique. The back 62, neck/shoulder assembly 64 and lower front 68 may comprise panels that are joined by sewn seams or other suitable technique. It will be seen that the elastic and inelastic parts of the shirt 60 contribute to making a torso section and sleeves of a somewhat conventional looking shirt.

In some embodiments, the material of the back 62, neck/shoulder assembly 64 and lower front 68 may include elastic panels 76 of intermediate strength to provide a transition between the heavy duty elastic material of the band 70 and sleeves 72 and the material of the neck/shoulder assembly 64 and torso encircling section 68. The panel 76 may comprise 100% polyester but may be nylon or a combination of polyester and nylon. Such materials are available commercially from Gehring Textiles, Inc. of Garden City, N.Y.

The chest band 70 and cuffs 72 are differentiated from the fabric sections 62, 64, 68 by their strength. The chest bands 70 and cuffs 72 are much stronger than the shirt sections 62, 64, 68. Thus, the chest band 70 is stronger than the fabric of the sections 62, 64, 68 of the same width and thickness by a factor of at least three, preferably by a factor of at least five and ideally more. The chest band 70 may be capable of supporting at least two hundred pounds and may preferably be capable of supporting much more, e.g. at least four hundred pounds. A prototype of the shirt 60 has been tested to a 685 pound bench press.

The elastic band 70 and the sleeves 72 are joined, as by sewing, so that movement of the lifter's arms toward the rear causes the sleeves 72 to move and stretch the band 70 thereby storing energy in the band 70. Conversely, movement of the lifter's arms toward the front allows the band 70 to assist in forward movement of the lifter's arms. It will be seen that the band 70 and sleeves 72 are similar to the exercise device shown in FIGS. 1-8 and U.S. Design Pat. No. 748,209. Thus, in a way, an exercise device has been incorporated into the a shirt so that movement of a lifter's arms alternately stores energy in the band when a weight is lowered and then expends energy when the weight is raised.

In a bench press exercise, a lifter on his back grasps a bar and raises it off a stand and lowers the bar until it is level with his chest. This moves the lifter's arms downwardly and rearwardly, distorts the sleeves 72 and lengthens the elastic band 70 thereby storing energy in the band 70. When the lifter raises the bar, energy stored in the band 70 assists in lifting the bar and thereby adding to the lifter's efforts. This allows the lifter to lift a greater weight than he could do without the elastic elements of the shirt 60.

Figure 12:
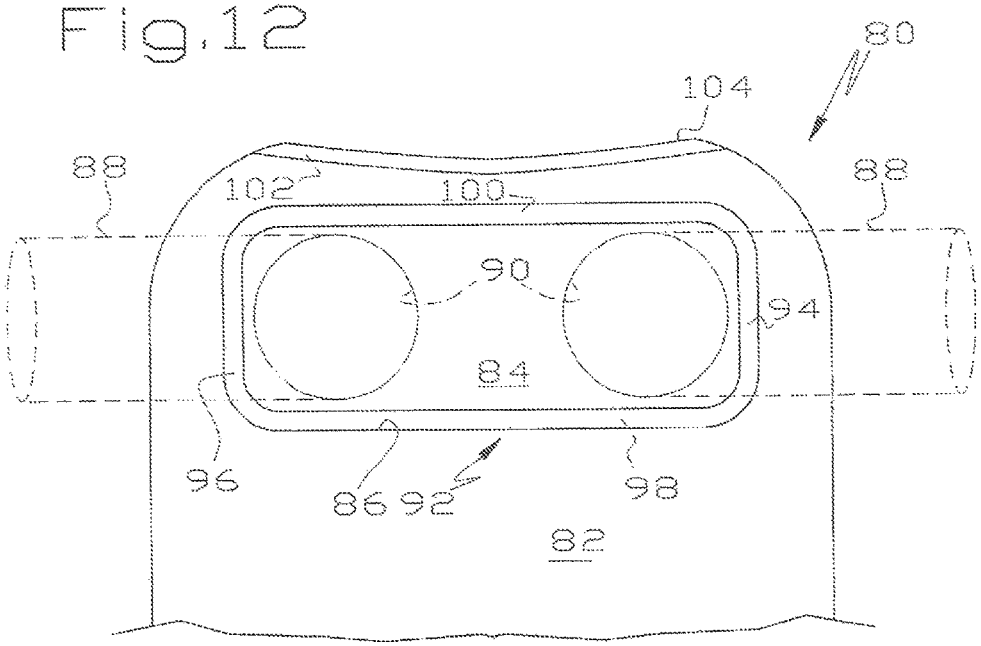
FIG. 12 is a front view of another embodiment of a shirt incorporating a performance enhancing elastic member.

Referring to FIG. 12 there is illustrated another lifter's shirt 80. As in the embodiment of FIGS. 8-11, the shirt 80 includes relatively weak fabric sections and a strong elastic chest band. The relatively weak fabric sections of the shirt 80 may include a torso encircling section 82 and an armhole section or panel 84 separated from the torso section 82 by a gap 86. Sleeves 88 extend around armholes 90 and project forwardly as in modern lifter's shirts. A strong elastic band 92 connects to the torso section 82 and to the armhole section 84 thereby spanning the gap 86. The band 88 accordingly includes left and right curved ends 94, 96 outside of the armholes 90 and horizontal sections 98, 100 merging with the curved sections 94, 96 above and below the armholes 90 and extending across the torso of the lifter. Thus, the strong elastic chest band 92 may be exclusively on the front of the shirt 80. The shirt 80 also includes a fabric collar 102 providing a neck hole 104. It will be seen that the fabric of the shirt 80 may be the same as the fabric of the shirt 60 and the material of the elastic member 92 may be the same as the material of the elastic members 12, 70.

When bench pressing with the shirt 80, a lifter lies on his back, typically on a bench and grasps a barbell with both hands, lowering a weight toward the chest. Lowering the barbell in a bench press movement, stretches the strong elastic member 92 thereby storing energy in the shirt 80. This stored energy is then available to assist the lifter in raising the barbell thereby increasing the weight that can be raised by the lifter.

Figure 13:
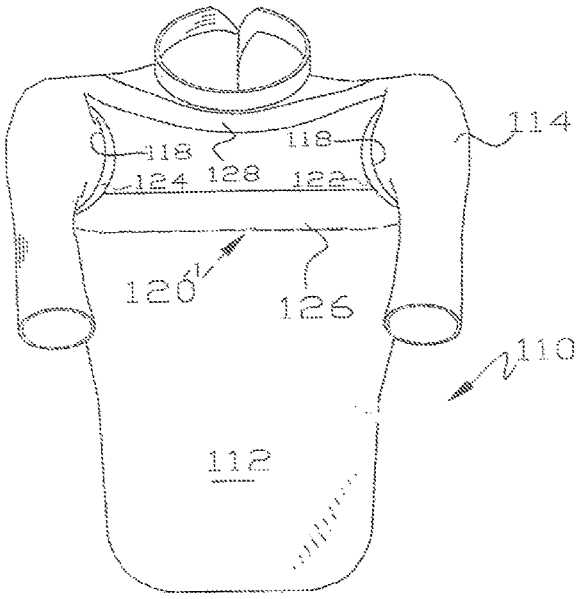
FIG. 13 is a front view of another embodiment of a shirt incorporating a performance enhancing elastic member.
Figure 14:
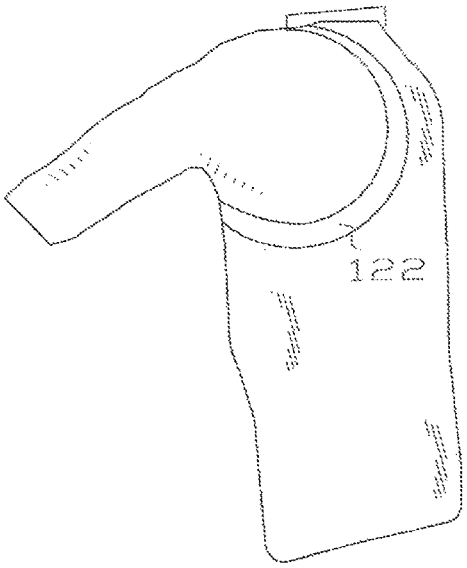
FIG. 14 is a side view of the embodiment of FIG. 13.

Referring to FIGS. 13-14, a lifter's shirt 110 may be provided having a torso section 112 and a pair of sleeves 114 opening through armholes 118 into the torso section 112 such that the sleeves 114 project out of the plane of the torso 112 at a 90° angle or less. The sleeves 114 may project downwardly as illustrated or may project upwardly. The shirt 110 includes an energy storage band 120 having looped ends 122, 124 on the outside of the armholes 118 and torso spanning sections 126, 128 which connect to the looped ends 122, 124 in any suitable manner, as by sewing. The material of the band 120 may be the same as the material of the elastic members 12, 70.

It will be seen that the energy storage bands 92, 120 of the embodiments of FIGS. 12-14 act to constrain movement of the sleeves 88, 114 outwardly in much the same manner that the elastic member 12 constrains outward movement of the cuffs 72. Accordingly, the sleeves 88, 114 may be made of a material stronger than might be expected. In one version, the sleeves 88, 114 are made of the same material as the cuffs 14, 72, i.e. a strong elastic fabric or rubber sheet. In other versions, the cuffs 14, 72 may be made of a strong fabric such as a one-ply synthetic polymer fabric of approximately 0.75 mm-1 mm thickness, about 15-35% of the strength of the rubber sheet 16 and elastic enough to accommodate stretch of the elastic bands 92, 120. It will be seen that the elastic sleeves 114 are directly connected, as by sewing or the like, to the loop 122 in the embodiment of FIGS. 13-14. In the embodiment of FIG. 12, the elastic sleeves 88 are connected indirectly to the elastic band 92 by the section or panel 84. Thus, the panel 84 may be of a strength sufficient to accommodate the forces involved.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. An arm and chest exercise device comprising:

first and second arm cuffs configured to respectively encircle an upper portion of a user's left and right arms; and a central elastic member of generally rectangular shape, the first and second arm cuffs being attached to opposite ends in a longitudinal direction of the central elastic member, the central elastic member having a length sufficient to extend across a chest of the user, the central elastic member comprising a rubber sheet having a width, length and thickness where the width and length are at least ten times the thickness;

wherein the rubber sheet is expansible in a first direction between the first and second arm cuffs and expansible in a second direction perpendicular to the first direction, expansibility of the rubber sheet in the first direction being substantially equal to expansibility of the rubber sheet in the second direction.

2. The arm and chest exercise device of claim 1 further comprising a fabric sleeve encasing the rubber sheet.

3. The arm and chest exercise device of claim 1 wherein the central elastic member comprises an outside and an inside, the inside configured to juxtapose the user's chest, the central elastic member further comprising a fabric layer on the inside of the central elastic member, the outside of the central elastic member comprising a side of the rubber sheet exposed to earth's atmosphere.

4. The arm and chest exercise device of claim 1 wherein the central elastic member comprises an outside and an inside, the inside configured to juxtapose a user's chest, and wherein the rubber sheet is exposed to earth's atmosphere on the inside and outside of the central elastic member.

5. The arm and chest exercise device of claim 1 wherein the first and second arm cuffs each comprise an impermeable rubber sheet and a fabric sleeve encasing the impermeable rubber sheet.

6. The arm and chest exercise device of claim 1 further comprising a handle attached to the central elastic member adjacent to a midpoint thereof and extending away from the central elastic member.

7. The arm and chest exercise device of claim 1 wherein the central elastic member comprises an outside and an inside, the inside configured to juxtapose a user's chest, wherein the rubber sheet is exposed to earth's atmosphere on the outside of the central elastic member, and wherein graphics are applied to an outside of the rubber sheet.

8. The arm and chest exerciser of claim 1 wherein the central elastic member comprises an outside and an inside, the inside configured to juxtapose the user's chest, the central elastic member further comprising a fabric covering the outside of the central elastic member, the fabric having a window exposing graphics on the rubber sheet.

9. An arm and chest exerciser comprising an elastic band configured to span a user's chest, a pair of arm cuffs connected to the elastic band, the arm cuffs each comprising an impermeable rubber sheet encased in a fabric sleeve, wherein the impermeable rubber sheet includes graphics and the fabric sleeve includes a window exposing the graphics.

10. An arm and chest exercise device comprising:

first and second arm cuffs configured to respectively encircle an upper portion of a user's left and right arms; and a central elastic member of generally rectangular shape, the first and second arm cuffs being attached to opposite ends in a longitudinal direction of the central elastic member, the central elastic member having a length sufficient to extend across a chest of the user, the central elastic member comprising a rubber sheet having a width, length and thickness where the width and length are at least ten times the thickness; and a handle attached to the central elastic member adjacent to a midpoint thereof and extending away from the central elastic member.

* * * * *